US007050737B2

(12) United States Patent
Kobayashi

(10) Patent No.: US 7,050,737 B2
(45) Date of Patent: May 23, 2006

(54) BELT DEVICE AND IMAGE FORMING APPARATUS USING THE SAME

(75) Inventor: Kazuhiko Kobayashi, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 39 days.

(21) Appl. No.: 10/666,245

(22) Filed: Sep. 22, 2003

(65) Prior Publication Data

US 2004/0126129 A1 Jul. 1, 2004

(30) Foreign Application Priority Data

Sep. 20, 2002 (JP) ..... 2002-274703
Oct. 17, 2002 (JP) ..... 2002-303376
Feb. 28, 2003 (JP) ..... 2003-054063

(51) Int. Cl.
*G03G 21/20* (2006.01)

(52) U.S. Cl. ..... 399/94

(58) Field of Classification Search ..... 399/91, 399/92, 94, 96, 162, 302, 303, 308, 312, 399/313; 219/216; 347/156
See application file for complete search history.

(56) References Cited

U.S. PATENT DOCUMENTS 4,025,180 A * 5/1977 Kurita et al. ..... 399/92
5,689,767 A * 11/1997 Domoto et al. ..... 399/94
6,167,221 A 12/2000 Kobayashi
6,266,498 B1 * 7/2001 Oda et al. ..... 399/92
6,501,923 B1 * 12/2002 Aoki et al. ..... 399/96
2002/0067934 A1 6/2002 Jia et al.
2002/0122679 A1 * 9/2002 Omata et al. ..... 399/309

FOREIGN PATENT DOCUMENTS

JP 2001-296755 10/2001

* cited by examiner

*Primary Examiner*—Sandra L. Brase
(74) *Attorney, Agent, or Firm*—Oblon, Spivak, McClelland, Maier & Neustadt, P.C.

(57) ABSTRACT

In a belt device passed over a plurality of rollers one of which is adjacent to a heat source, the temperature of part of a belt moving in the vicinity of the heat source varies little relative to the temperature of the other part of the belt.

51 Claims, 14 Drawing Sheets

BELT DEVICE AND IMAGE FORMING APPARATUS USING THE SAME

BACKGROUND OF THE INVENTION

1. Field of the Invention

The present invention relates to a belt device capable of protecting a belt from stretch ascribable to thermal expansion and therefore from the variation of moving speed, and an image forming apparatus using the same.

2. Description of the Background Art

A copier, printer, facsimile apparatus or similar image forming apparatus is constructed to develop a latent image formed on a photoconductive drum or similar image carrier with toner and transfer the resulting toner image to a sheet or recording medium. A monochromatic toner image, for example, is directly transferred from the drum to the sheet. In the case of full-color image formation, toner images of different colors formed on a plurality of image carriers are sequentially transferred to an intermediate image transfer body one above the other to form a composite color image (primary image transfer), and then the composite color image is transferred to a sheet (secondary image transfer).

The intermediate image transfer body is usually implemented as a belt or a drum. As for a belt, Japanese Patent Laid-Open Publication Nos. 5-270686 and 8-152790, for example, propose to sequentially transfer toner images of different colors to one surface of a sheet being conveyed by a belt via consecutive image formation stations while electrostatically adhering to the belt. Japanese Patent Laid-Open Publication No. 2001-109325 discloses an image forming apparatus constructed to circulate a sheet via consecutive image forming stations by use of a belt in order to form toner images on both surfaces of the sheet.

An image forming apparatus of the type including image forming stations arranged side by side along a belt is generally referred to as a tandem, four-color image forming apparatus. The image forming stations use color toners complementary to separated colors, i.e., red, green and blue and black toner. A problem with this type of image forming apparatus is that color shift occurs if the image transfer start position differs from one image forming station to another image forming station. One of various causes of color shift is the variation of the moving speed of the belt which is, in turn, ascribable to the variation of mechanical characteristics of the belt, particularly the variation of the dimension of the belt ascribable to stretch caused by thermal expansion.

More specifically, a belt is passed over a plurality of metallic rollers and caused to turn thereby. When the belt stretches due to thermal expansion ascribable to heat accumulation, the amount of movement of the belt varies in accordance with the stretch with the result that the moving speed varies for a unit time with respect to a preselected distance.

Today, to meet the increasing demand for the size reduction of an image forming apparatus, when the image forming stations are arranged side by side along the belt, the distance between nearby image forming stations is decreasing. In addition, the distance between a fixing unit configured to fix a toner image on a sheet and the downstream end of a path along which the belt conveys the sheet is decreasing for the same purpose. It is therefore likely that the belt is heated and caused to expand by the fixing unit. Particularly, among rollers over which the belt is passed, a roller adjacent to the fixing unit transfers heat to the belt more than the others due to a material constituting it, aggravating the thermal expansion of the belt.

While a fixing member included in the fixing unit is constantly operated to maintain its surface at preselected temperature, the belt is sometimes brought to a halt when not conveying a sheet. When the belt is held in a halt, part of the belt adjacent to the fixing thermally expands more than the other part. Consequently, after the halt, the belt again starts moving at speed different from expected speed due to stretch ascribable to thermal expansion. This causes the transfer position of an image of the first color and the transfer positions of images of the second and successive colors to be shifted from each other, resulting in color shift. Further, in the case of a monochromatic image, a black image is enlarged in the subscanning direction and becomes defective.

Even when the belt is in movement, part of the belt passed over a roller adjacent to a heat source is apt to thermally expand due to heat transferred via the roller. The moving speed of the belt therefore varies not only at the time of resumption of movement but also during image forming operation, preventing images of different colors from being transferred in accurate register.

To protect the belt from excessive temperature elevation, Japanese Patent Laid-Open Publication No. 2001-296755, for example, proposes to use a heat pipe as the roller adjacent to the fixing unit or to use an exhaust fan for exhausting air around the belt or a cooling fan for cooling the belt. However, such a mechanism for forcibly cooling the belt and roller over which it is passed needs a sophisticated, bulky configuration as well as special control, resulting in an increase in size and cost. Moreover, some lag exists between the time when the heat pipe starts cooling or cooling air starts being fed and the time when the temperature of the belt actually drops, extending a period of time up to the resumption of movement of the belt, i.e., image transfer.

SUMMARY OF THE INVENTION

It is an object of the present to provide a belt device capable of allowing a belt itself to control its temperature elevation without increasing cost, and an image forming apparatus including the same.

It is another object of the present invention to provide a belt device capable of preventing a belt speed from varying by reducing the thermal expansion of the belt without increasing cost, and an image forming apparatus including the same.

In a belt device passed over a plurality of rollers one of which is adjacent to a heat source, the temperature of part of a belt moving in the vicinity of the heat source varies little relative to the temperature of the other part or the belt.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
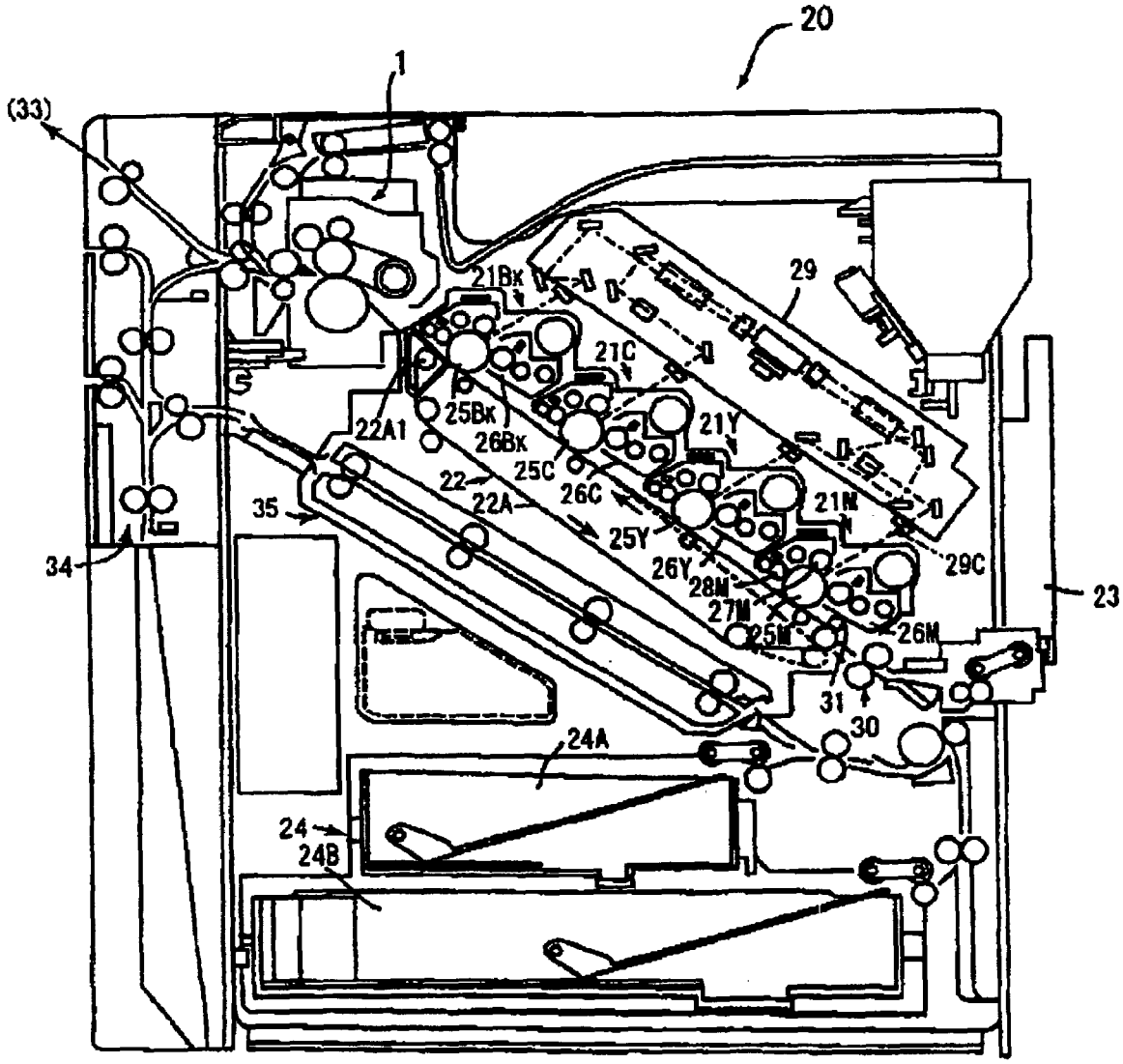
FIG. 1 is a view showing the general construction of an image forming apparatus to which a belt device embodying the present invention is applied.

Referring to FIG. 1 of the drawings, an image forming apparatus to which a belt device embodying the present invention is applied is shown and implemented as a tandem, four-color copier or printer by way of example. The image forming apparatus may, of course, be implemented as a facsimile apparatus or even a black-and-white image forming apparatus. The illustrative embodiment directly transfers toner images of different colors from image carriers to a sheet or recording medium being conveyed by an image transfer belt one above the other.

As shown in FIG. 1, the image forming apparatus, generally 20, includes image forming units 21M (magenta), 21Y (yellow), 21C (cyan) and 21BK (black) and image transferring unit 22 facing the image forming units 21M through 21BK. A manual sheet feed tray or sheet feeding means 23 feeds a sheet or recording medium laid thereon by hand to a position where the image forming units 21M through 21BK and image transferring device 22 face each other. A first and a second sheet cassette 24A and 24B are mounted on a sheet feeder 24. A registration roller pair 30 conveys a sheet fed from any one of the manual sheet feed tray 23 and sheet cassettes 24A and 24B in synchronism with image formation effected by the image forming units 21M through 21BK. A fixing unit 1 fixes a toner image formed on the sheet.

The fixing unit 1 uses a fixing belt positioned to face an image and heated, although not specifically. This type of fixing unit 1 includes a heat source for heating the belt and a fixing roller and a press roller that form a nip therebetween. The belt is passed over the fixing roller and heat source and moves via the above nip.

The image transferring unit 22 includes an image transfer belt or image transfer body (simply belt hereinafter) 22A passed over a plurality of rollers. The image transferring unit 22 further includes bias applying means 22M, 22C, 22Y and 22BK for image transfer, see FIG. 2, and bias applying means 31 for adhesion. The bias applying means 31 is movable into contact with the belt 22A for applying a bias that causes a sheet to electrostatically adhere to the belt 22A before the transfer of a first color to the sheet, as will be described more specifically later.

The apparatus 20 is capable of dealing with any one of plain papers customary with, e.g., a copier and special sheets greater in thermal capacity than paper sheets, e.g., OHP (OverHead Projector) sheets, cards, postcards and other 90K sheets, thick sheets corresponding to weight of about 100 $g/m^2$, and envelopes.

Figure 2:
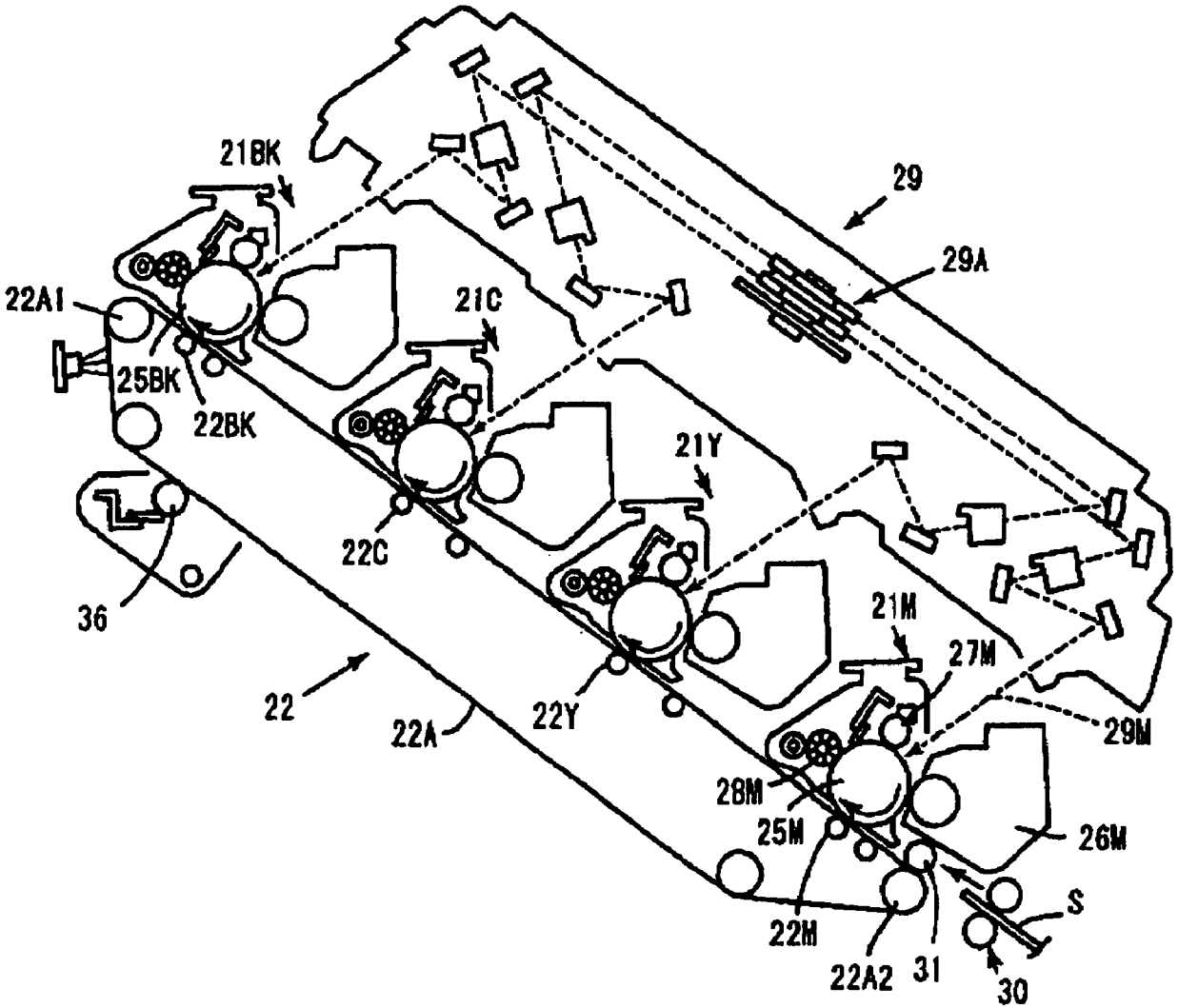
FIG. 2 is a perspective view showing image forming sections included in the illustrative embodiment together with an image transferring unit.

FIG. 2 shows the image forming units 21M through 21BK in detail. Because the image forming units 21M through 21BK are identical in configuration except for the color of toner to use, let the following description concentrate on the image forming unit 21M by way of example. As shown, the image forming unit 21M includes a photoconductive drum of image carrier 25M. Sequentially arranged around the drum 25M, as named in the direction of rotation of the drum 25M (clockwise), are a charger 27M, a developing device 26M, and a cleaning device 28M. A light beam 29M, issuing from a writing unit 29, scans the surface of the drum 25M imagewise at a position between the charger 27M and the developing device 26M. The drum 25M may be replaced with any other suitable image carrier, e.g., a photoconductive belt.

In the apparatus 20 shown in FIG. 1, the image transferring unit 22 extends obliquely and therefore occupies a minimum of space in the horizontal direction.

The operation of the apparatus 20 will be described hereinafter. While the operation will be described by taking the image forming unit 21M as an example, it similarly applies to the other image forming units 21Y, 21C and 21BK.

A main motor, not shown, causes the drum 25M to rotate while the charger 27, applied with an AC bias not containing a DC component, discharges the surface of the drum 25M to a reference potential of about −50 V. Subsequently, an AC-biased DC bias is applied to the charger 27M so as to uniformly charge the surface of the drum 25M to a potential substantially equal to the DC component of the bias, e.g., substantially −500 V to −700 V; a target potential is determined by a process controller not shown.

In the writing unit 29, a laser emits a laser beam in accordance with a bilevel emission signal modulated in accordance with digital image data. The laser beam is incident to the drum 25M by way of a cylindrical lens, not shown, a polygonal mirror 29A, an fθ lens, not shown, a first to a third mirror, and a WTL lens. As a result, the surface potential of the drum 25M changes to about −50 V in a portion scanned by the laser beam, forming a latent image.

The developing device 26M includes a sleeve to which an AC-biased DC voltage of −300 V to −500 V is applied.

Toner deposited on the sleeve and complementary in color to a separated color is transferred from the sleeve to the latent image carried on the drum 25M to thereby produce a corresponding toner image. The toner has a Q/M value ranging from −20 μC/g to −30 μC/g.

The registration roller pair 30 conveys the sheet at preselected timing stated earlier. Before reaching the belt 22A, the sheet is caused to electrostatically adhere to the belt 22A by a bias applied from the bias applying means 31. When the belt 22A conveys the sheet electrostatically retained thereon, toner images formed on the consecutive drums are sequentially transferred to the sheet one above the other by biases opposite in polarity to the toner applied from the bias applying means 22M through 22BK, completing a full-color image.

The sheet, carrying the full-color toner image thereon, is then separated from a drive roller, labeled 22A1 in FIG. 2, included in the image transferring unit 22 on the basis of curvature. Subsequently, the full-color toner image is fixed on the sheet by the fixing unit 1, FIG. 1. The sheet is then conveyed to a tray such as print tray 33 in a simplex print mode.

Among the rollers over which the belt 22A is passed, the drive roller 22A1 adjacent to the fixing unit 1 is configured to obstruct heat transfer to the belt 22A. For this purpose, the drive roller 22A1 is implemented as a solid or a hollow roller formed of a material lower in thermal conductivity than metal and therefore allowing a minimum of heat to accumulate. This successfully obstructs the temperature elevation and therefore thermal expansion of the belt 22A when the belt 22A is in a halt. The belt 22A is therefore free from stretch ascribable to thermal expansion, obviating color shift ascribable to the variation of the moving speed of the belt 22A.

Figure 3:
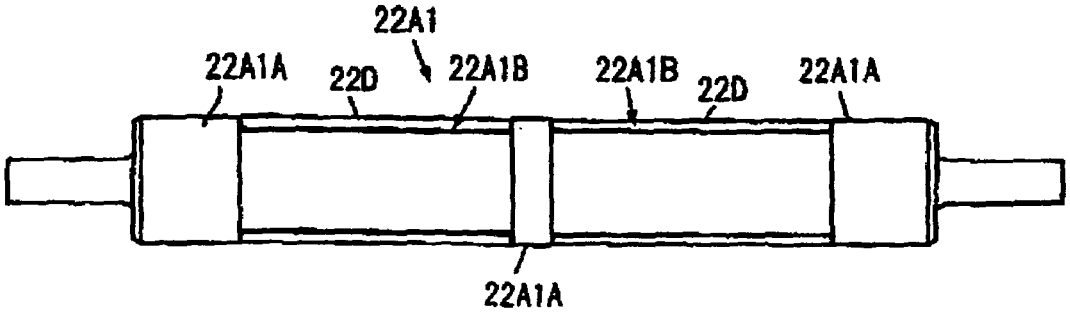
FIG. 3 is a front view showing a specific configuration of a roller included in the illustrative embodiment and over which a belt is passed.

FIG. 3 shows a specific configuration of the drive roller 22A1. As shown, the drive roller 22A1 includes belt passing portions 22A1A over which the belt 22A is passed and heat non-conductive portions 22A1B; the portions 22A1A and 22A1B alternating with each other in the axial direction of the drive roller 22A1, as illustrated. The belt passing portions 22A1A are implemented as metallic surfaces capable of serving as optical reflection surfaces. The heat non-conductive portions 22A1B comprise flexible members 22D fitted on the base of the drive roller 22A1, which is smaller in diameter than the belt passing portions 22A1, and capable of contacting the belt 22A. The flexible members are formed of resin or similar non-metallic material lower in thermal conductivity than metal.

To form the belt passing portions 22A1A, a metallic surface used as the base of the drive roller 22A1 may be polished or, when the base of the drive roller 22A1 is formed of resin, extremely smooth metallic layers may be formed on the base by evaporation. The belt passing portions 22A1A are used to sense image density on the belt 22A1 or the position of the belt 22A. More specifically, a photosensor, not shown, is located to face the belt 22A for sensing the density of an image or for positioning the belt 22A by sensing a positioning mark provided on the belt 22A. Light, issuing from the photosensor, is reflected by either one of the first surfaces 22A1A.

The heat non-conductive portions 22A1B, formed in portions other than the end portions in the axial direction, are configured to prevent the belt 22 from getting thereon when the belt 22A is shifted to either side. More specifically, the heat non-conductive portions 22A1B are more flexible and therefore less rigid than the belt passing portions 22A1A and likely to sink when the belt 22A gets thereon, causing the belt 22A to stretch and obstruct expected image transfer.

The flexible members 22D fitted on the heat non-conductive portions 2ZA1B have an outside diameter equal to or slightly smaller than the outside diameter of the belt passing portions 22A1A and play the role of backup members for the belt 22A. The heat non-conductive portions 22A1B are electrically conductive and provided with specific resistance of $10^{-2}$ Ω·cm$^2$ to $10^{-1}$ Ω·cm$^2$. Electric conductivity prevents the charge potential of the heat non-conductive portions 22A1B from rising due to frictional charge on contacting the belt 22A. This prevents toner deposited on the belt 22 from being scattered by repulsing the charge potential.

Figure 4:
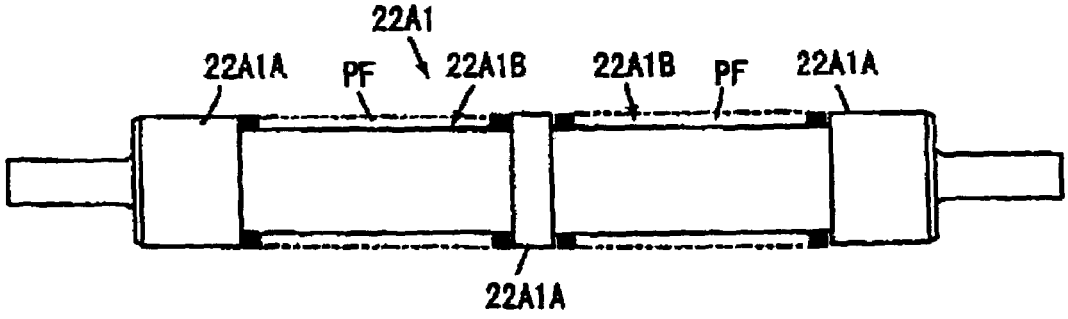
FIG. 4 is a view similar to FIG. 3, showing a modified form of the roller.
Figure 5:
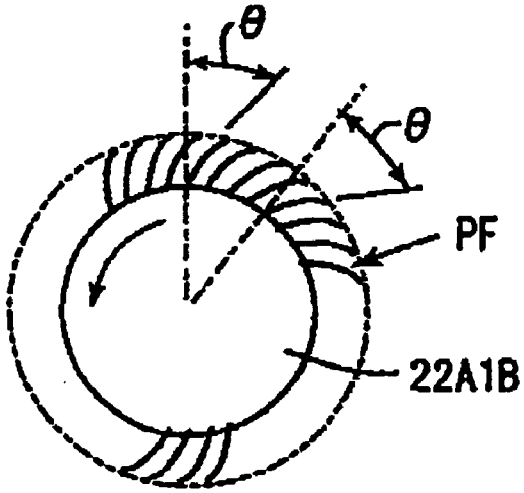
FIG. 5 is a section showing bristles implanted on the roller of FIG. 4.

FIG. 4 shows a modified form of the drive roller 22A1. As shown, the drive roller 22A1 includes flexible bristles PF implanted on the base, which is smaller in diameter than the belt passing portions 22A1A, and capable of contacting the belt 22A at their tips. As shown in FIG. 5, the bristles PF are inclined relative to lines tangential to the smaller diameter portions other than the belt passing portions 22A1A. More specifically, the bristles PF are inclined such that they fall down rearward in the direction of rotation of the drive roller 22A1. The angle of inclination θ is the same throughout the bristles PF.

The bristles PF have the same length and are formed of a material lower in thermal conductivity than the base of the drive roller 22A1 and having specific resistance of $10^{-3}$ Ω·cm$^2$ to $10^{-1}$ Ω·cm$^2$. The material applied to the bristles PF is electrically conductive in order to prevent the charge potential of the bristles PF from rising due to frictional charge on contacting the belt 22A. This is also successful to obviate toner scattering stated earlier.

The bristles PF are arranged in the same positions as the flexible members 22, FIG. 3, and provided with the same electric property as the flexible members 22 and implanted in density of 1,000/cm$^2$ to 50,000/cm$^2$. The height H of the bristles PF is selected such that the bristles PF have the same outside diameter as the belt passing portions 22A1A or can contact the inner surface of the belt 22A.

More specifically, the density and height H of the bristles PF are so selected as to cause the bristles PF to play the role of a backup portion for preventing the belt 22A from, e.g., waving. Further, the height H is selected in consideration of the rise of thermal conductivity that would occur if the bristles PF were short due to a decrease in air layers. The height H should preferably be 1±0.8 mm.

When the roller 22A1 is rotated to turn the belt 22A, the belt 22A moves in contact with the bristles PF. At this instant, the bristles PF, inclined in the previously stated direction beforehand, are prevented from irregularly falling down in the circumferential direction of the drive roller 22A1. Therefore, the distances between the tips of the bristles PF and the axis of the drive roller 22A1 are the same and do not vary, so that the moving speed of the belt 22A does not vary.

Figure 6:
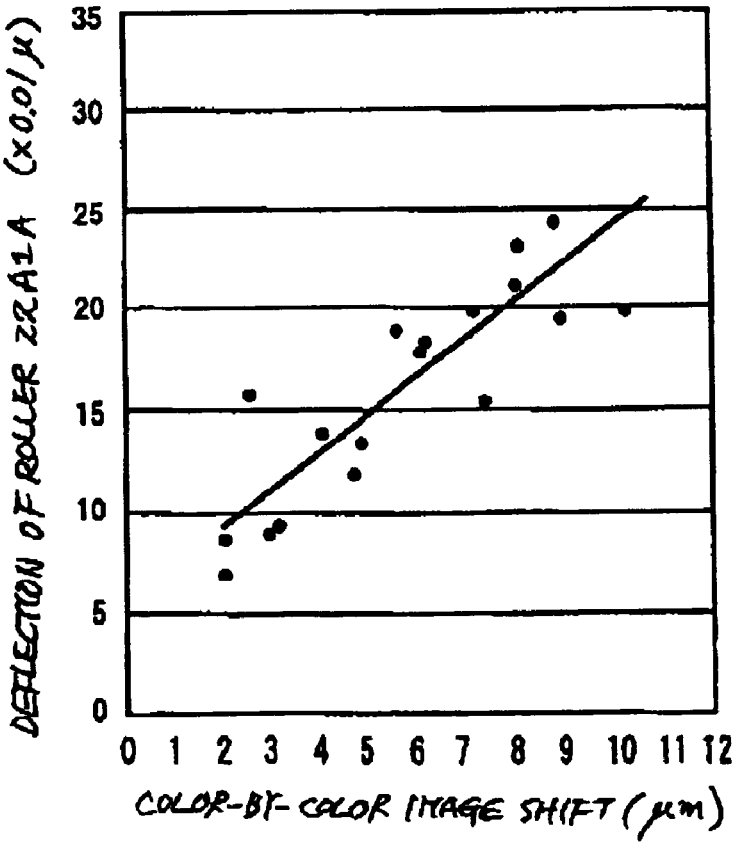
FIG. 6 is a graph showing a relation between the deflection of a roller and the shift of an image at each image forming section.
Figure 7:
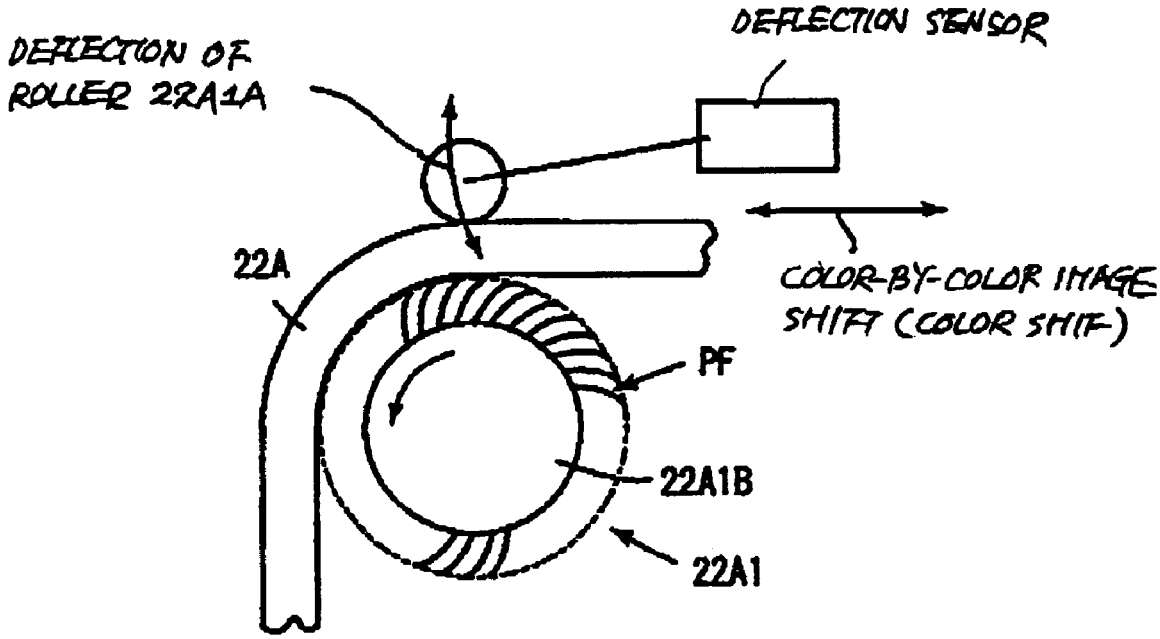
FIG. 7 shows a configuration used to determine the relation of FIG. 6.

Experiments were conducted to determine a relation between color shift to occur between consecutive image transfer and deflection ascribable to the drive roller 22A1 in the radial direction that has influence on the variation of the moving speed of the belt 22A. FIG. 6 plots the results of experiments. FIG. 7 shows an arrangement used for the experiments. As shown, the arrangement included a deflection sensor responsive to the amplitude of the belt 22A in the radial direction of the drive roller 22A1. Color shift occurred at each of consecutive image transfer was measured in relation to the output of the deflection sensor.

As FIG. 6 indicates, color shift increases in accordance with the variation of the distance to the inner surface of the belt 22A, i.e., the tips of the bristles PF. In the illustrative embodiment, the distances between the tips of the bristles PF and the axis of the drive roller 22A1 are uniform in the circumferential direction of the drive roller 22A1, so that deflection ascribable to the drive roller 22A1 is reduced. Consequently, color shift ascribable to irregularity in the moving speed of the belt 22A is reduced.

As stated above, in the illustrative embodiment, the bristles PF are inclined in a preselected condition and can be implanted without taking account of irregularity particular to straight bristles, i.e., an occurrence that some bristles are straight, but some bristles are inclined. This promotes accurate control at the time of implantation for thereby obviating color shift.

More specifically, when straight bristles are simply implanted, they are apt to be irregularly distributed or irregular in position due to, e.g., a non-uniform electrostatic environment. Therefore, the distances between the tips of the bristles and the axis of a roller on which the bristles are implanted are, in many cases, not the same. As a result, the peripheral speed of the roller finely varies relative to a belt and makes the movement of the belt contacting the bristles irregular. Particularly, when images of different colors are superposed on each other, irregularity in the moving condition of the belt shifts the position where the images should be superposed, resulting in color shift.

If desired, the bristles PF implanted in the drive roller 22A1 may be replaced with unwoven cloth constituted by fibers having the same characteristics as the bristles PF and capable of being held in an inclined position.

Figure 8:
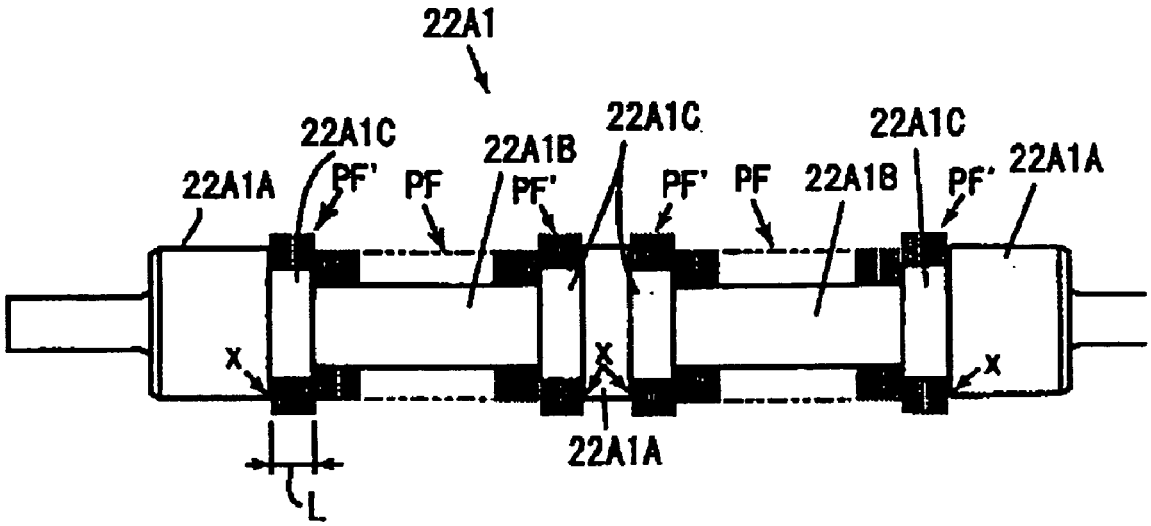
FIG. 8 is a front view showing another modification of the roller.

FIG. 8 shows another modification of the drive roller 22A1. As shown, the drive roller 22A1 additionally includes step portions 22A1C each having an outside diameter smaller than the outside diameter of the belt passing portion 22A1A adjoining it, but larger than the outside diameter of the heat non-conductive portion 22A1B The step portions 22A1C are included in the heat non-conductive portions 22A1B. Bristles PF' identical in length are implanted on the step portions 22A1C in the same manner as the bristles PF implanted on the heat non-conductive portions 22A1B.

As shown in FIG. 8, the distance between the tips of the bristles PF' implanted on the step portions 22A1C and the axis of the drive roller 22A1 is greater than the distance between the tips of the bristles PF' implanted on the heat non-conductive portions 22A1B, so that the tips of the bristles PF' are positioned radially outward of the belt passing portions 22A1A. In this configuration, the bristles PF' prevent the inner surface of the belt 22A from easily contacting the edges X of the belt passing portions 22A1A and being damaged thereby.

The bristles PF' are arranged over a length L, as measured in the axial direction of the roller 22A1, only large enough to prevent the inner surface of the belt 22A from directly contacting the edges X of the belt passing portions 22A1A. In the modification, the length L is selected to be about 3 mm although it is dependent on the axial length of the drive roller 22A1.

As stated above, the modification shown in FIG. 8 extends the life of the belt 22A while achieving the same advantages as the previous modification.

Figure 9:
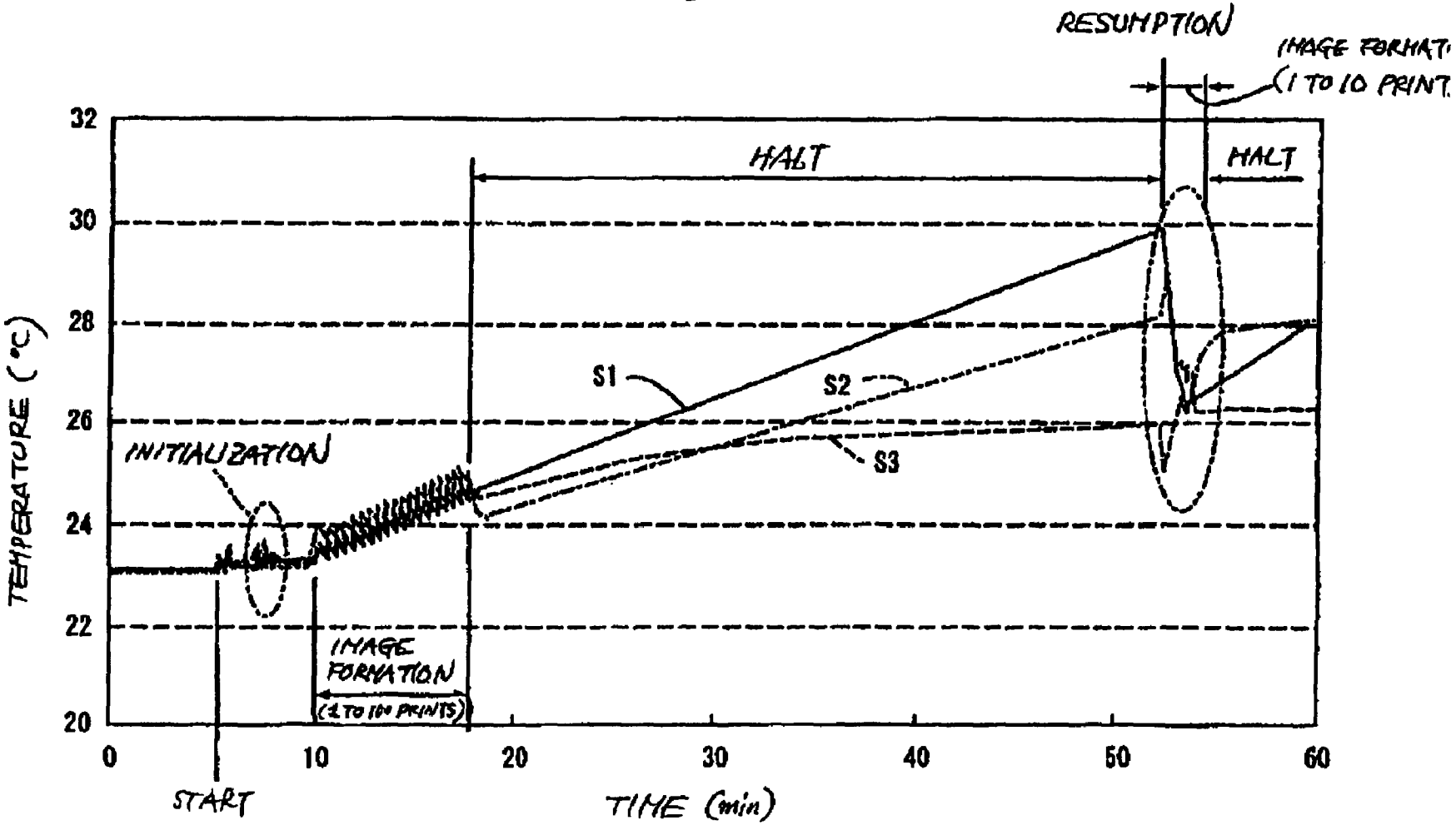
FIG. 9 is a chart showing temperature variation of various parts of the belt with respect to time.

Experiments were conducted with a conventional roller to determine the temperature variation of the belt 22A. FIG. 9 shows the results of experiments, i.e., the temperature variation of the belt 22A in the circumferential direction. In FIG. 9, lines S1, S2 and S3 respectively correspond to positions S1, S2 and S3 shown in FIG. 10 at each of which a particular temperature sensor is located. The position S1 corresponds to the position of the drive roller 22A1. The position S2 corresponds to part of the belt 22A moved away from the drive roller 22A1. Further, the position S3 corresponds to the upper run of the belt 22A facing the consecutive image forming sections.

For the experiments, the various sections of the apparatus 20 were initialized after the start of operation. Subsequently, the belt 22 was stopped after the output of 100 prints and then left in a halt for 30 minutes. Thereafter, twenty more prints were output. At this time, the experimental results shown in FIG. 9 were obtained.

As FIG. 9 indicates, the temperature of the belt 22A differs from one position to another at the time of resumption of image transfer. More specifically, after the start of operation, the belt 22A continuously moves while conveying consecutive sheets, so that the temperature distribution in the circumferential direction is substantially uniform. However, when the belt 22A is left in a halt after the initial image formation, the temperature of the belt 22A noticeably rises at the positions S1 and S2 adjacent to the drive roller 22A1. As a result, the tendency of temperature elevation differs from one position to another position when image formation is resumed. This indicates that the belt 22A stretches in a different amount in part thereof with the result that the image transfer start position of the belt 22A is shifted, resulting in color shift.

As for the specific experiments stated above, the belt 22A was left in a halt for 30 minutes before the resumption of image transfer. In practice, however, the belt 22A is more influenced by the heat of the fixing unit 1 as the halt time becomes longer unless power supply to the fixing unit 1 is interrupted to establish, e.g., an energy saving mode. As a result, it is likely that the belt 22A is heated to an excessive degree. It is therefore necessary to take account of the fact that the halt time is apt to induce the stretch of the belt 22A, depending on the status of the fixing unit 1.

Figure 11A:
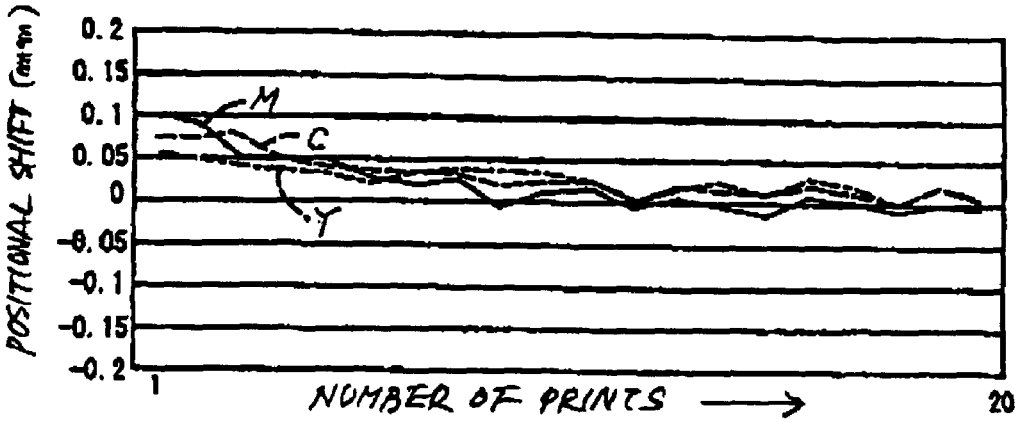
FIG. 11A PRIOR ART
FIGS. 11A through 11C show experimental results comparing the belt of the illustrative embodiment and a conventional belt with respect to the shift of an image transfer position.
Figure 11B:
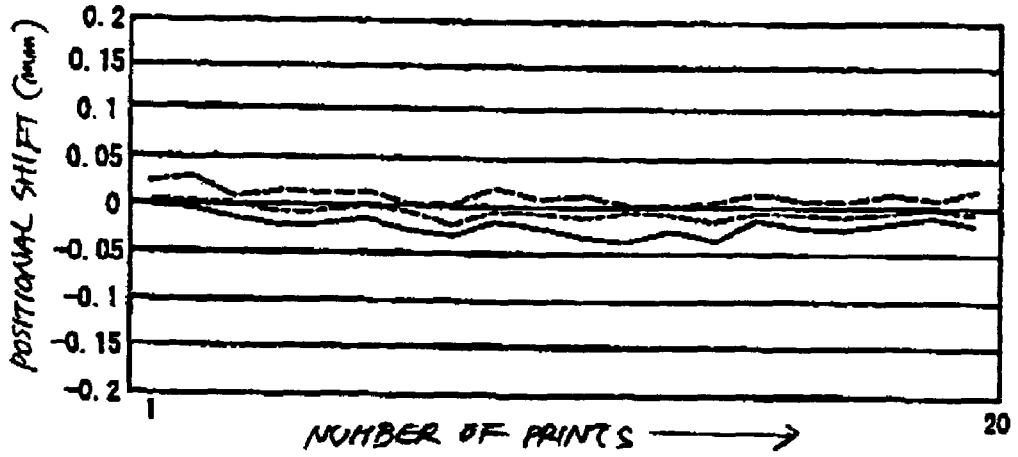
Figure 11C:
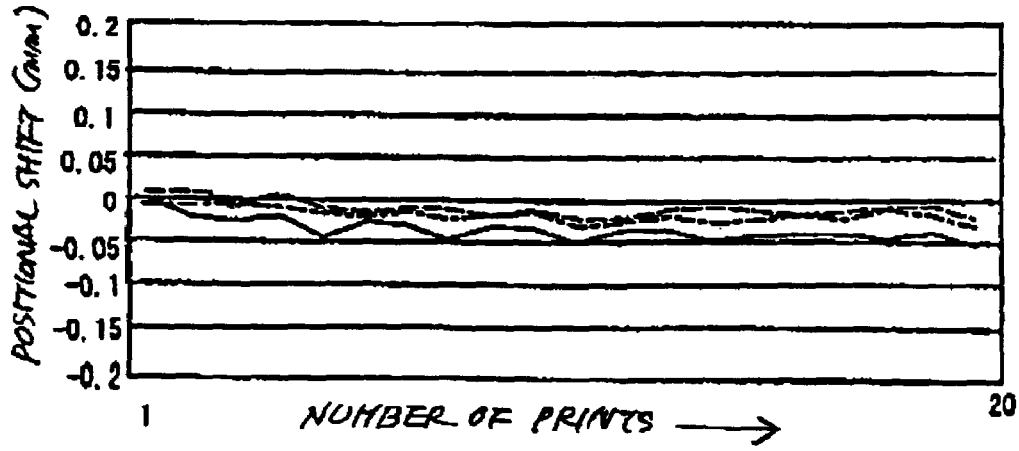

Experiments were also conducted with the illustrative embodiment to determine a relation between the temperature variation or thermal expansion and the color shift. FIGS. 11A through 11C, 12A through 12C and 13A through 13C indicate the results of experiments. FIGS. 11A through 11C each plot the shifts of magenta, cyan and yellow from black in relation to the number of sheets conveyed. The results of FIGS. 11A through 11C were respectively obtained with a conventional metallic roller formed of stainless steel, the roller 22A1 with unwoven cloth lower in thermal conductivity than metal, and the roller 22A1 with the configuration shown in FIG. 4 or 8.

Figure 12A:
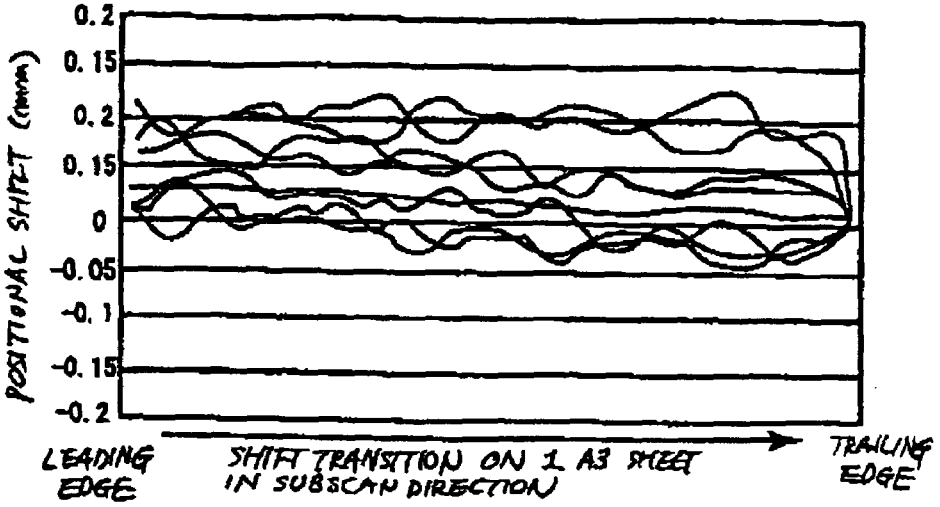
FIG. 12A PRIOR ART
FIGS. 12A through 12C show experimental results comparing the belt of the illustrative embodiment and the conventional belt with respect to positional shift in the moving direction or subscanning direction.
Figure 12B:
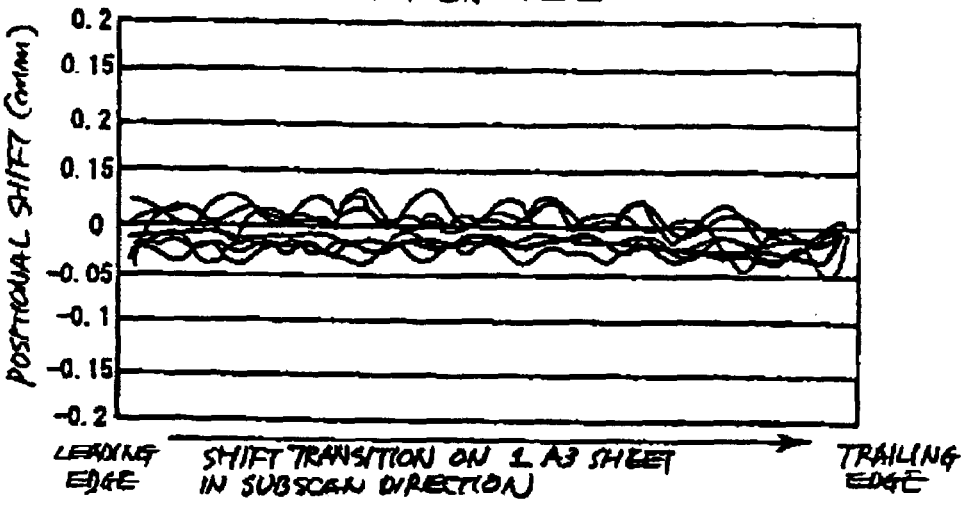
Figure 12C:
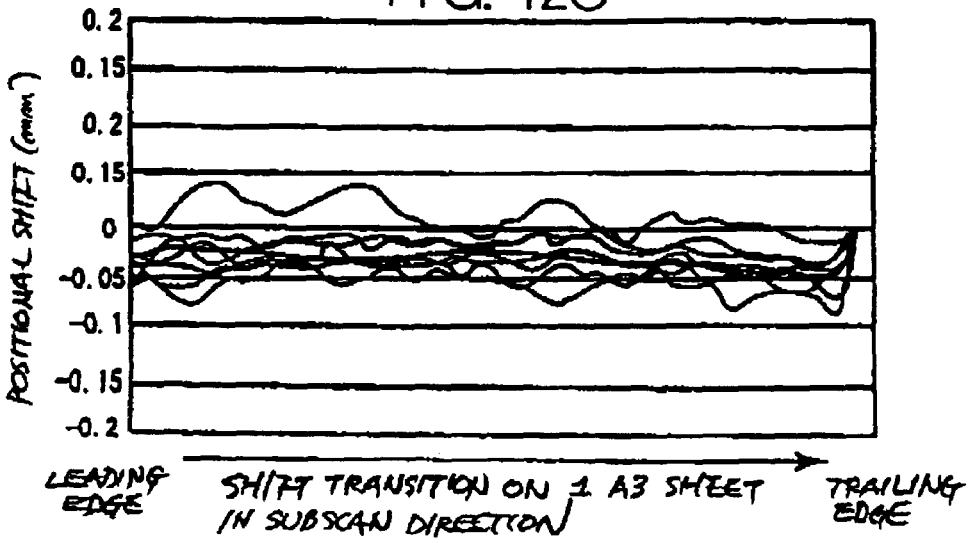
Figure 13A:
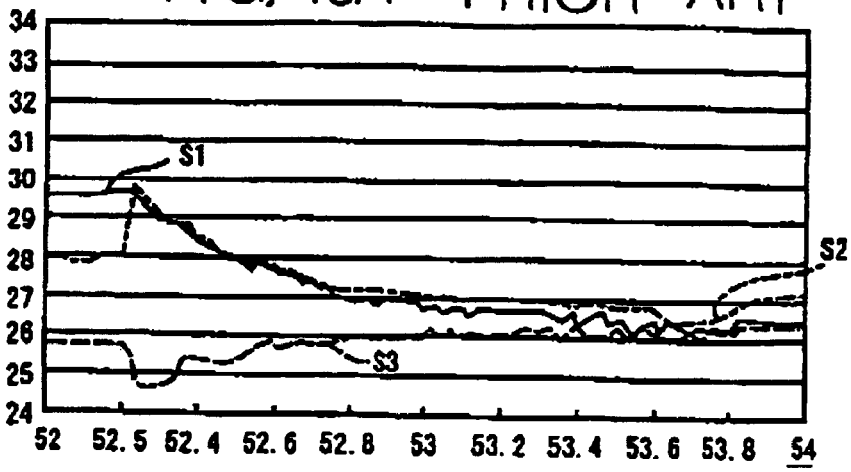
FIG. 13A PRIOR ART
FIGS. 13A through 13C show experimental results comparing the belt of the illustrative embodiment and the conventional belt with respect to temperature variation at various portions.

FIGS. 12A through 12C pertain to the positional shift of, e.g., a magenta image in the direction of movement of the belt 22A, i.e., in the substanning direction and plot color shift in the subscanning direction determined with the three kinds of drive rollers stated above by outputting a plurality of prints. Further, FIGS. 13A through 13C plot temperature sensed at the positions S1 through S3, FIG. 3, with the drive rollers stated in relation to FIGS. 11A through 11C.

When the belt 22A is caused to resume its movement for image transfer, the conventional roller shown in FIG. 11A brought about a greater positional shift than the rollers of the illustrative embodiment shown in FIGS. 11B and 11C. Also, As shown in FIGS. 12B and 12C, the rollers of the illustrative embodiment caused little positional shift to occur (shift centering around "0"). By contrast, as shown in FIG. 12A, the conventional roller makes the tendency of positional shift offset in accordance with the stretch of the belt.

Figure 10:
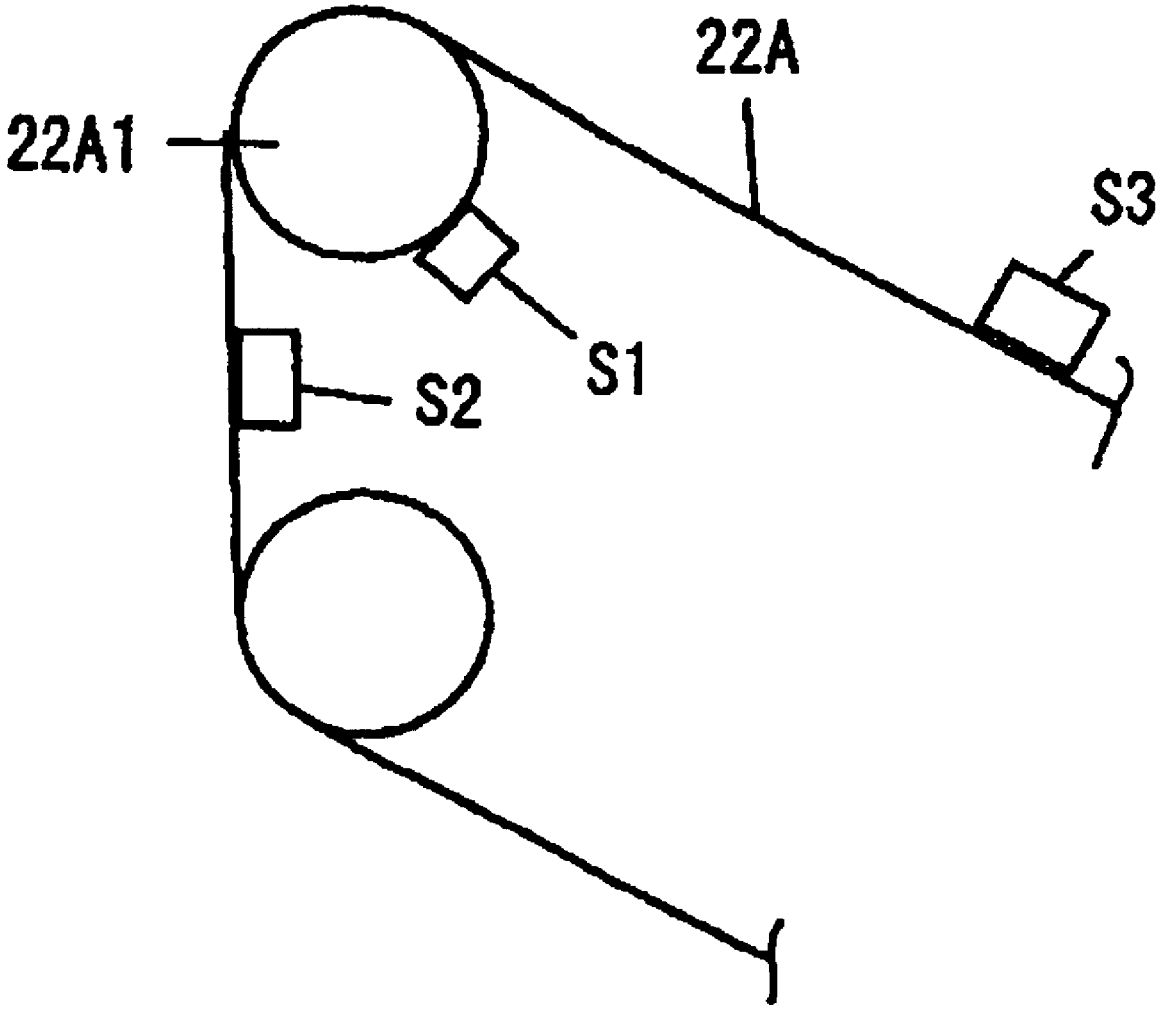
FIG. 10 shows positions where the temperature of the belt was sensed.
Figure 13B:
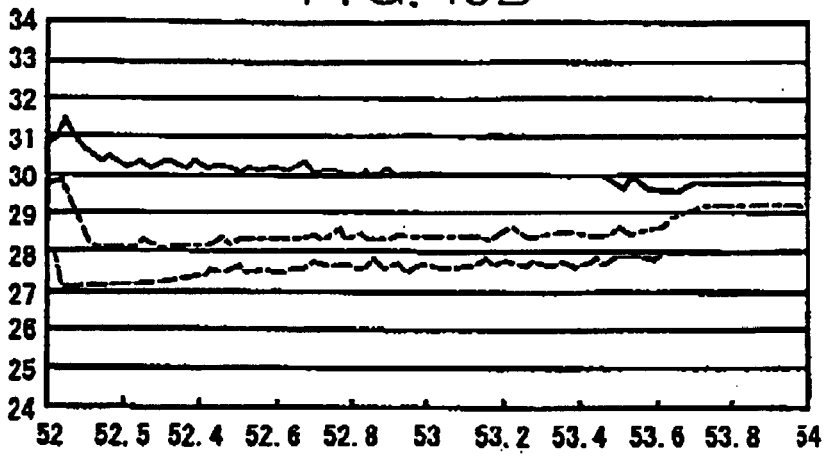
Figure 13C:
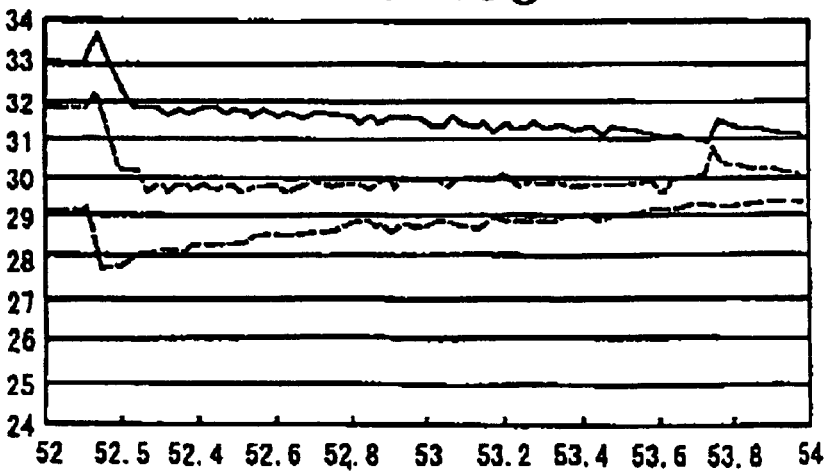

As for temperature variation at various positions measured during continuous conveyance, as shown in FIGS. 13B and 13C, the rollers of the illustrative embodiment make temperature uniformly vary at the positions S1 and S2, FIG. 10. However, as shown in FIG. 13A, temperature variation available with the conventional roller is not uniform and causes the belt to stretch. In FIGS. 13A through 13C, why temperature at the position S3 drops at the initial stage is that part of the belt 22A moves from a position remote from the drive roller 22A1 to the position S1 and that sheets absorb heat. While temperatures shown in FIGS. 13B and 13C locally differ from each other, the difference is simply derived from frictional heat ascribable to the contact of a probe and a measurement error.

As FIGS. 11A through 12C indicate, the illustrative embodiment obstructs heat transfer from the drive roller 22A1 to the belt 22A for thereby reducing temperature elevation of the belt 22A. This reduces the stretch of the belt 22A and therefore obviates color shift otherwise occurring when image formation is resumed.

The illustrative embodiment is applicable to a photoconductive belt, which may be substituted for the photoconductive drum, in the same manner as it is applied to the image transfer belt 22A. In such a case, one of rollers, supporting the photoconductive belt, adjoining a fixing unit will be provided with the same configuration as the drive roller 22A.

As stated above, the illustrative embodiment protects the belt 22A from stretch and therefore obviates color shift simply by preventing one of the rollers, supporting the belt 22A, adjacent to the fixing unit from transferring heat to the belt 22A, i.e., without resorting to an exclusive cooling mechanism. Further, the illustrative embodiment does not monitor temperature elevation that causes the belt 22A to stretch, but obviates the temperature elevation of the belt 22A itself and therefore makes it unnecessary to cool off the belt 22A. This obviates a time delay from the start of cooling to the actual drop of temperature to preselected one. It is therefore possible to obviate color shift while simplifying the construction.

It is to be noted that the illustrative embodiment is, of course, applicable to a driven roller if it is positioned at a high temperature position in the circumferential surface of the belt 22A.

Figure 14:
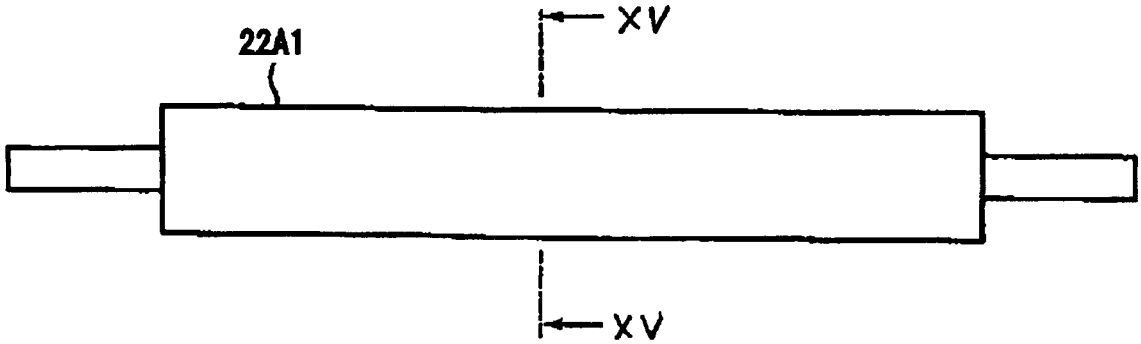
FIG. 14 is a front view showing a roller representative of an alternative embodiment of the present invention.
Figure 15A:
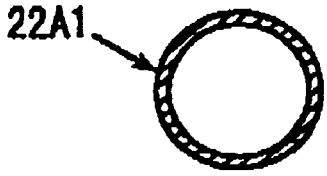
FIGS. 15A through 15D are sections each sowing a specific configuration of the roller of FIG. 14.

An alternative embodiment of the present invention will be described hereinafter. FIGS. 1, 2, 9 and 10 referenced for the description of the previous embodiment directly apply to the alternative embodiment as well. The following description will therefore concentrate on arrangements characterizing the alternative embodiment. As shown in FIG. 14, in the illustrative embodiment, the drive roller 22A1 is implemented as a metallic roller formed of aluminum, stainless steel (SUS), steel or similar good conductor that forms an even surface. As shown in FIG. 15A, the drive roller 22A1 is a hollow roller radiating more heat than the other rollers. The temperature of a hollow roller drops more rapidly than a solid roller. The drive roller 22A1 is provided with wall thickness of 5 mm or less and therefore smaller thermal capacity than the other rollers.

With the above configuration, the drive roller 22A is capable of radiating the heat of the belt 22A heated by the fixing unit 1 and therefore controlling the thermal expansion of the belt 22A. The temperature of the belt 22A therefore rapidly drops and becomes uniform throughout various positions. The belt 22A therefore stretches little and moves at constant speed, obviating color shift and image shift.

Figure 15B:
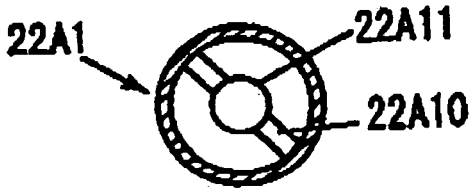
Figure 15C:
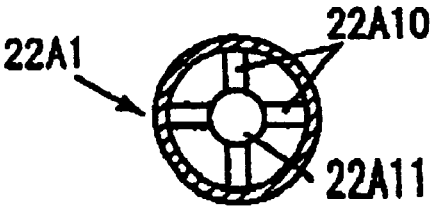
Figure 15D:
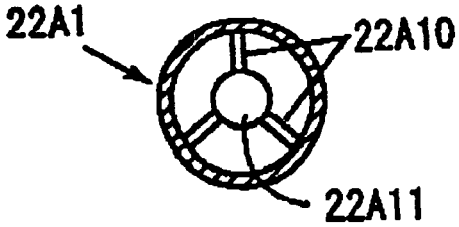

FIGS. 15B through 15D each show a particular modification of the hollow drive roller 22A1. As shown, the drive roller 22A1 may be provided with a single rib 22A10 as shown in FIG. 15B or provided with a plurality of ribs 22A10 as shown in FIGS. 15C and 15D. The single rib 22A10, FIG. 15B, extends between a boss 22A11 formed on the shaft of the drive roller 22A1 and the inner periphery of the drive roller 22A1 and is positioned at least at the center in the axial direction.

The rib or ribs 22A10 are significant in the following respect. The hollow drive roller 22A1 provided with preselected wall thickness can have its rigidity lowered. More specifically, when the belt 22A having width in the axial direction of the drive roller 22A1 is passed over the drive roller 22A1, the drive roller 22A1 supports the opposite edges of the belt 22A. In this condition, a bending moment increases at the intermediate portion of the drive roller 22A1 and tends to cause the intermediate portion to bend. The rib or ribs 22A10 serve to increase the rigidity of the drive roller 22A1 against bending and therefore allow the belt 22A to uniformly contact the drive roller 22A1 in the axial direction of the drive roller 22A1. It follows that contact pressure between the belt 22A and the drive roller 22A1 is maintained uniform to prevent the tension of the belt 22A from varying in the direction of width.

Figure 16A:
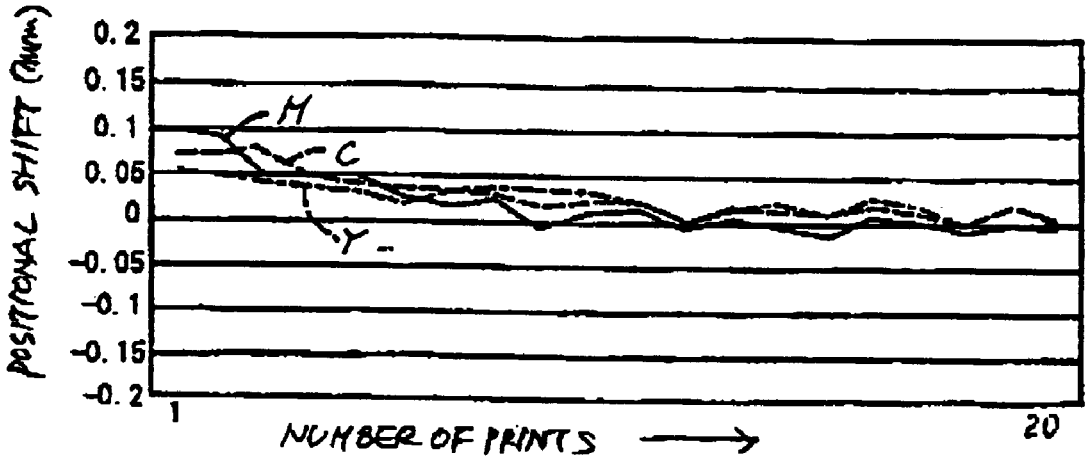
FIG. 16A PRIOR ART
FIGS. 16A and 16B compare the belt of the alternative embodiment and the conventional belt with respect to the shift of an image transfer position.
Figure 16B:
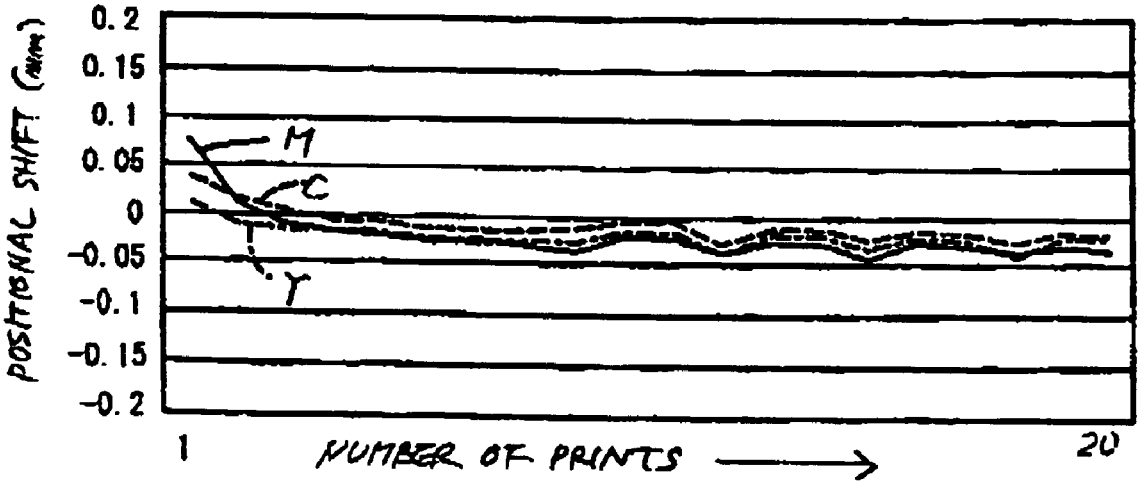
Figure 17A:
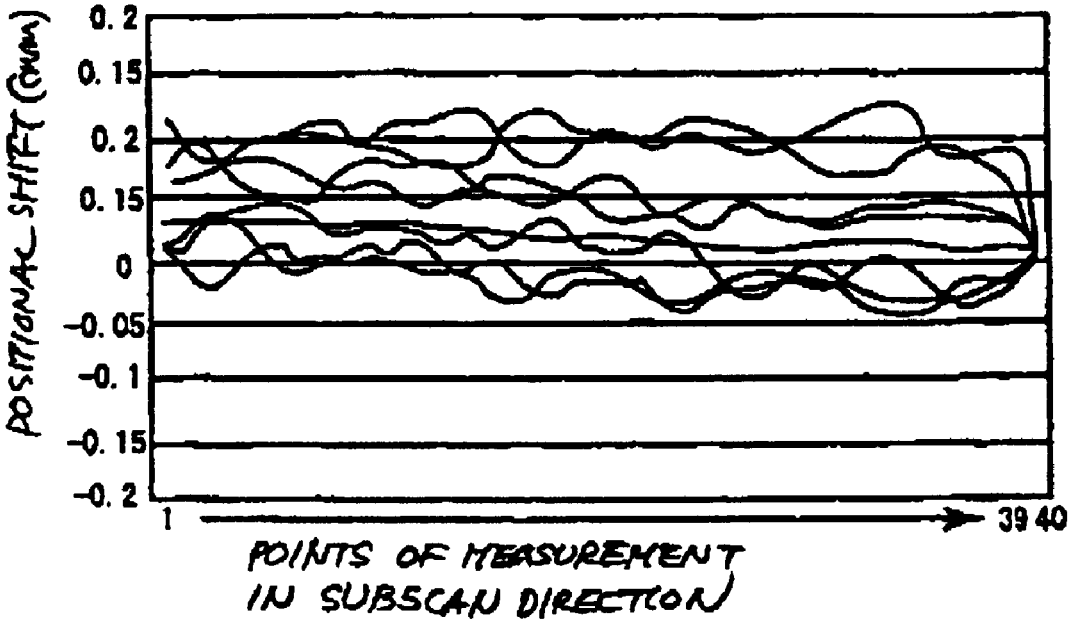
FIG. 17A PRIOR ART
FIGS. 17A and 17B compare the belt of the alternative embodiment and the conventional belt with respect to positional shift in the moving direction or subscanning direction.
Figure 17B:
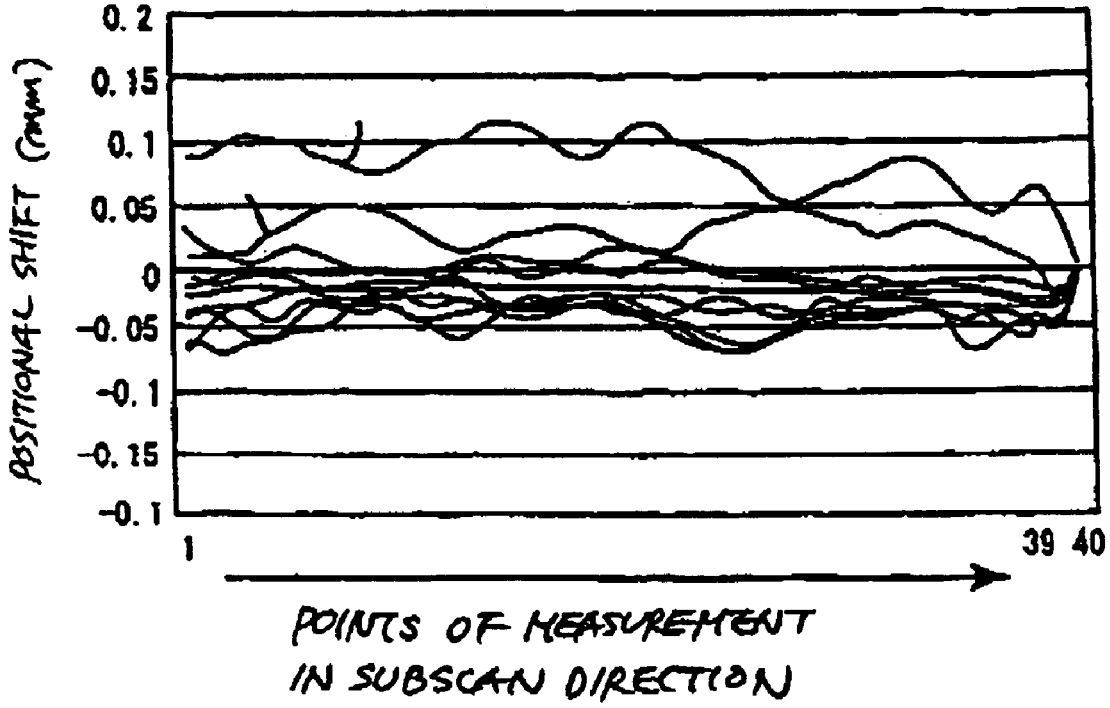
Figure 18A:
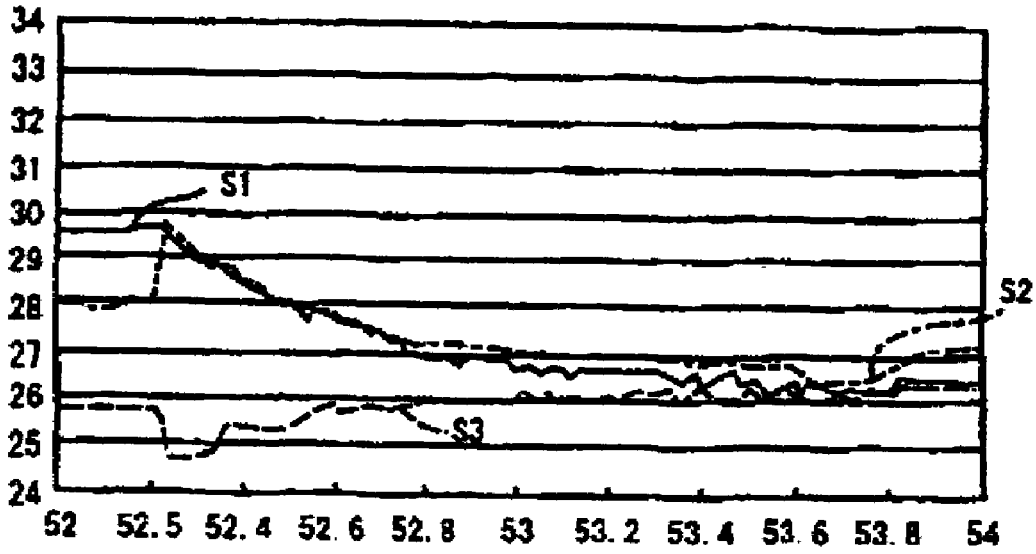
FIG. 18A PRIOR ART
FIGS. 18A and 18B compare the belt of the alternative embodiment and the conventional belt with respect to temperature variation at various portions.
Figure 18B:
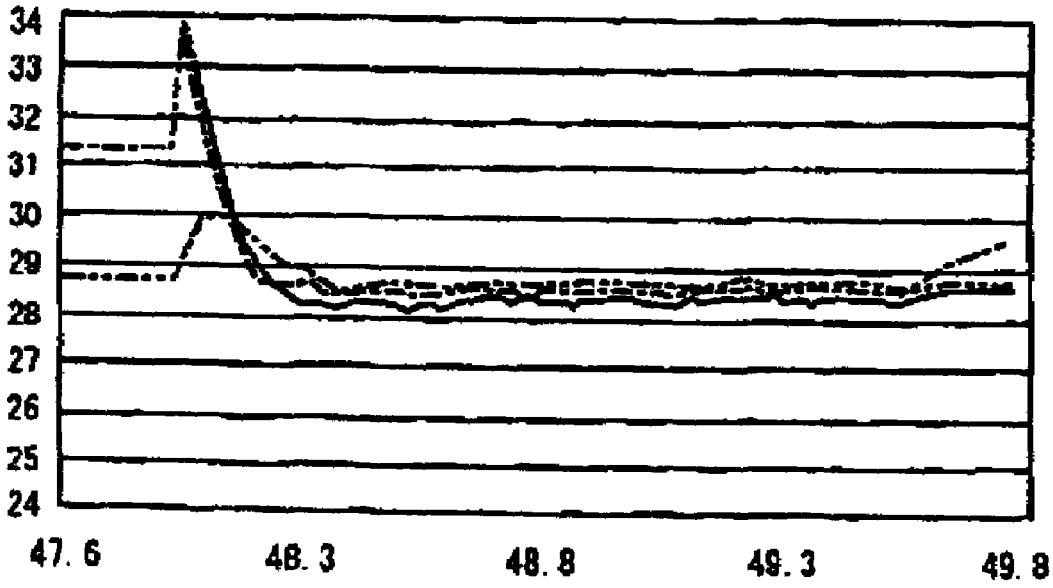

FIGS. 16A, 16B, 17A, 17B, 18A and 18B show the results of experiments conducted with the illustrative embodiment to determine positional shift. FIGS. 16A and 16B plot the shift of magenta, cyan and yellow from black measured with a conventional solid roller formed of stainless steel (FIG. 16A) and the hollow or tubular roller of the illustrative embodiment (FIG. 16B). FIGS. 17A and 17B plot positional shift measured in the direction of movement of the belt 22A, i.e., subscanning direction with a magenta image and the two kinds of rollers stated above. The results of FIGS. 17A and 17B were obtained by repeatedly measuring positional shift at the time of resumption of image transfer. FIGS. 18A and 18B plot temperature measured at the positions shown in FIG. 10 also by using the above two kinds of rollers.

By comparing FIGS. 16A and 16B, it will be seen that a greater number of prints should be output with the conventional roller than with the illustrative embodiment before positional shift converges. Also, as FIGS. 17A and 17B indicate, although the illustrative embodiment causes positional shift in the direction of movement of the belt 22A to occur on the initial one or two prints after resumption, positional shift rapidly returns to around zero on the successive prints. By contrast, as FIG. 17A indicates, the conventional roller causes offset positional shift to occur on more than one or two prints. Such a difference is derived from a difference in the stretch or part of the belt 22A passed over the drive roller 22A1.

As FIGS. 18A and 18B indicate, as for temperature variation at various positions measured during continuous conveyance, the illustrative embodiment makes temperature variation at the positions S1 and S2, FIG. 10, uniform in a short period of time. By contrast, the conventional roller cannot make temperature variation uniform and causes the belt to stretch. Temperature at the position S3 drops in the initial stage because part of the belt 22A remote from the drive roller 22A1 moves to the position S1 and because sheets absorb heat.

As FIGS. 16*a* through 18B indicate, the illustrative embodiment obstructs heat transfer from the drive roller 22A1 to the belt 22A for thereby reducing temperature elevation of the belt 22A. This reduces the stretch of the belt 22A and therefore obviates color shift otherwise occurring when image formation is resumed.

The illustrative embodiment is configured to reduce the temperature elevation of the belt 22A adjoining the fixing unit or heat source by providing the drive roller with thermal capacity smaller than that of the other rollers. If desired, a material that enhances heat conduction may be coated on or adhered to the surface of the drive roller 22A so long as it does not adversely effect frictional contact between the belt 22A and the drive roller 22A1.

The image forming apparatus shown in FIG. 1 includes a controller, not shown, for controlling, e.g., image form timing at each image forming section and timing for conveying a sheet to the belt 22A. The controller allows a sheet to start being conveyed on condition that temperature becomes even between the drive roller 22A and the other rollers.

More specifically, only when the outputs of the temperature sensors, FIG. 10, indicate that temperature at various positions is uniform, the controller allows a sheet to start being conveyed. This prevents the temperature of part of the belt 22A passed over the drive roller 22A1 from rising and therefore prevents the belt 22A from stretching, thereby obviating the shift of an image transfer position at each image forming section. It follows that a color image is free form color shift while a monochromatic image is free from the accidental enlargement of an image in the subscanning direction or direction of conveyance.

If desired, image shift or similar positional shift ascribable to the stretch of the belt 22A may be corrected only under the same conditions as stated in relation to the timing for starting conveying a sheet. In such a case, accurate Correction is achievable by excluding the variation of conveying speed ascribable to thermal expansion, which is an uncertain factor.

Various modifications will become possible for those skilled in the art after receiving the teachings of the present disclosure without departing from the scope thereof.

What is claimed is:

1. In a belt device passed over a plurality of rollers one of which is adjacent to a heat source, a temperature of part of a belt moving in the vicinity of said heat source varies little relative to a temperature of the other part of said belt, wherein said roller adjacent to the heat source comprises metallic and non-metallic portions, said non-metallic portions having a lower thermal conductivity than metal.

2. The belt device as claimed in claim 1, wherein said belt is passed over said plurality of rollers, and one of said plurality of rollers adjacent to the heat source is configured to obstruct heat transfer to said belt.

3. The belt device as claimed in claim 1, wherein said roller adjacent to the heat source comprises belt passing portions over which said belt is passed in an axial direction of said roller and heat non-conductive portions not conducting heat.

4. The belt device as claimed in claim 3, wherein said heat non-conductive portions are lower in thermal conductivity than metal.

5. The belt device as claimed in claim 3, wherein said belt passing portions comprise metallic surfaces capable of serving as optical reflecting surfaces.

6. The belt device as claimed in claim 3, wherein said heat non-conductive portions each comprise a flexible member capable of contacting said belt.

7. The belt device as claimed in claim 3, wherein said heat non-conductive portions each comprise bristles implanted and capable of contacting said belt.

8. The belt device as claimed in claim 7, wherein said bristles have a density of $1{,}000/cm^2$ to $50{,}000/cm^2$.

9. The belt device as claimed in claim 7, wherein said bristles have a height equal to an outside diameter of said belt passing portions or great enough for said bristles to contact said belt.

10. The belt device as claimed in claim 3, wherein said heat non-conductive portions are formed at positions other than end portions of said roller in an axial direction of said roller.

11. The belt device as claimed in claim 3, wherein said heat non-conductive portions are formed of an electrically conductive material.

12. The belt device as claimed in claim 11, wherein said heat non-conductive portions have a specific resistance of $10^{-3}$ Ω·cm to $10^{-1}$ Ω·cm.

13. In an image forming apparatus using a belt device, said belt device is passed over a plurality of rollers one of which is adjacent to a heat source, and a temperature of part of a belt moving in the vicinity of said heat source varies little relative to a temperature of the other part of said belt, wherein said roller adjacent to the heat source comprises metallic and non-metallic portions, said non-metallic portions having a lower thermal conductivity than metal.

14. The apparatus as claimed in claim 13, wherein said belt constitutes an image transfer body, and one of said rollers over which said belt is passed is adjacent to a fixing unit including a heat source.

15. The apparatus as claimed in claim 14, wherein a plurality of image carriers are arranged side by side and allow respective latent images corresponding to different colors to be formed thereon and developed by toners complementary in color to said latent images to thereby form corresponding toner images, said belt, conveying a sheet electrostatically adhering to said belt, moves via said plurality of image carriers to thereby cause said toner images to be sequentially transferred to said sheet one above the other and conveys said sheet further to a fixing unit.

16. The apparatus as claimed in claim 13, wherein said belt constitutes a photoconductive element, and one of rollers over which said belt is passed is adjacent to the fixing device including a heat source.

17. In a belt device comprising a belt passed over a plurality of rollers and capable of moving said belt via said plurality of rollers, bristles are implanted on a circumferential surface of any one of said plurality of rollers except for belt passing portions over which said belt is passed, and said bristles are arranged in an axial direction of said roller and each are inclined relative to a line tangential to said circumferential surface.

18. The belt device as claimed in claim 17, wherein said bristles are implanted on at least one roller located at a position where a temperature is high in a temperature distribution in a direction of movement of said belt.

19. The belt device as claimed in claim 17, wherein said bristles are inclined in a direction in which said bristles fall down rearward in a direction of rotation of said roller.

20. The belt device as claimed in claim 17, wherein said bristles are inclined by a same angle.

21. The belt device as claimed in claim 17, wherein a distance between an axis of said roller and tips of said bristles differs, in the axial direction of said roller, from positions adjoining said belt passing portions to the other portions.

22. The belt device as claimed in claim 21, wherein the tips of said bristles at the positions adjacent to said belt passing portions are positioned radially outward of said belt passing portions.

23. The belt device as claimed in claim 21, wherein said bristles have a same length as each other.

24. The belt device as claimed in claim 17, wherein positions of said roller, adjoining said belt passing portions in the axial direction of said roller, have an outside diameter smaller than said belt passing portions, but larger than the other positions.

25. The belt device as claimed in claim 17, wherein said bristles are implanted in a range of said roller other than end portions in the axial direction of said roller.

26. The belt device as claimed in claim 17, wherein said bristles are lower in thermal conductivity than a material forming said roller.

27. The belt device as claimed in claim 17, wherein said bristles are electrically conductive.

28. The belt device as claimed in claim 17, wherein said bristles are formed of a material having a specific resistance of $10^{-3}$ $\Omega\cdot cm^2$ to $10^{-1}$ $\Omega\cdot cm^2$.

29. The belt device as claimed in claim 17, wherein said bristles have a density of 1,0001 $cm^2$ to 50,0001 $cm^2$.

30. The belt device as claimed in claim 17, wherein said belt passing portions of said roller comprise metallic surfaces capable of serving as optical reflecting surfaces.

31. In an image forming apparatus using a belt device, said belt device comprises a belt passed over a plurality of rollers and is capable of moving said belt via said plurality of rollers, bristles are implanted on a circumferential surface of any one of said plurality of rollers except for belt passing portions over which said belt is passed, and said bristles are arranged in an axial direction of said roller and each are inclined relative to a line tangential to said circumferential surface.

32. The apparatus as claimed in claim 31, wherein said belt constitutes an image transfer body, and one of said rollers over which said belt is passed is adjacent to a fixing device including a heat source.

33. The apparatus as claimed in claim 31, wherein said belt constitutes an image carrier, and one of said rollers over which said belt is passed is adjacent to a fixing device including a heat source.

34. The apparatus as claimed in claim 31, wherein said belt is used for a color image forming process capable of forming a plurality of images of different colors.

35. The apparatus as claimed in claim 34, wherein said belt is used for a plurality of tandem image forming sections arranged side by side and constitutes an image transfer belt having a surface movable via said plurality of tandem image forming sections, whereby images of different colors formed by said image forming sections are transferred to said surface of said image transfer belt or a recording sheet, electrostatically adhering to said belt, one above the other.

36. In a belt device passed over a plurality of rollers one of which is adjacent to a heat source, a temperature of part of a belt, moving in the vicinity of said heat source, is made identical with a temperature of the other part in a short period of time, the temperature of said roller adjacent to the heat roller drops in a shorter period of time than a solid metallic roller, and when said roller adjacent to the heat roller comprises a hollow roller, at least one radially extending rib is positioned inside said hollow roller.

37. The belt device as claimed in claim 36, wherein said belt is passed over a plurality of rollers, one of said plurality of rollers adjacent to the heat source radiates a greater amount of heat than the other rollers.

38. The belt device as claimed in claim 36, wherein said roller adjacent to the heat source comprises a hollow roller.

39. The belt device as claimed in claim 36, wherein when said roller adjacent the heat roller comprises a hollow roller, a wall thickness of said roller is 5 mm or below.

40. The belt device as claimed in claim 36, wherein said roller adjacent to the heat roller is formed of a good conductor selected from at least aluminum, stainless steel (SUS) and steel.

41. In an image forming apparatus using a belt device, said belt device is passed over a plurality of rollers one of which is adjacent to a heat source, and a temperature of part of a belt, moving in the vicinity of said heat source, is made identical with a temperature of the other part in a short period of time, the sheet starts being conveyed toward an image transfer position after the temperature of said belt has been made equal at a position where said belt moves in the vicinity of the heat source and the other positions.

42. The apparatus as claimed in claim 41, wherein said belt constitutes an image transfer body, and one of said rollers over which said belt is passed is adjacent to a fixing unit including a heat source.

43. The apparatus as claimed in claim 42, wherein said belt constitutes a photoconductive element, and one of rollers over which said belt is passed is adjacent to the fixing device including a heat source.

44. The apparatus as claimed in claim 42, wherein a plurality of image carriers are arranged side by side and allow respective latent images corresponding to different colors to be formed thereon and developed by toners complementary in color to said latent images to thereby form corresponding toner images, said belt, conveying a sheet electrostatically adhered to said belt, moves via said plurality of image carriers to thereby cause said toner images to be sequentially transferred to said belt one above the other and conveys said sheet further to a fixing unit.

45. The apparatus as claimed in claim 41, wherein control for correcting a shift of an image position starts being executed after the temperature of said belt has been made equal at a position where said belt moves in the vicinity of the heat source and the other positions.

46. In an image forming apparatus using a belt device, said belt device is passed over a plurality of rollers one of which is adjacent to a heat source, and a temperature of part of a belt, moving in the vicinity of said heat source, is made identical with a temperature of the other part in a short period of time, wherein control for correcting a shift of an image position starts being executed after the temperature of said belt has been made equal at a position where said belt moves in the vicinity of the heat source and the other positions.

47. The apparatus as claimed in claim 46, wherein said belt constitutes an image transfer body, and one of said rollers over which said belt is passed is adjacent to a fixing unit including a heat source.

48. The apparatus as claimed in claim 47, wherein said belt constitutes a photoconductive element, and one of rollers over which said belt is passed is adjacent to the fixing device including a heat source.

49. The apparatus as claimed in claim 47, wherein a plurality of image carriers are arranged side by side and allow respective latent images corresponding to different colors to be formed thereon and developed by toners complementary in color to said latent images to thereby form corresponding toner images, said belt, conveying a sheet electrostatically adhered to said belt, moves via said plurality of image carriers to thereby cause said toner images to be sequentially transferred to said belt one above the other and conveys said sheet further to a fixing unit.

50. The apparatus as claimed in claim 47, wherein a plurality of image carriers are arranged side by side and allow respective latent images corresponding to different colors to be transferred, sequentially, to an intermediate image transfer body and then to a sheet.

51. The apparatus as claimed in claim 46, wherein the sheet starts being conveyed toward an image transfer position after the temperature of said belt has been made equal at a position where said belt moves in the vicinity of the heat source and the other positions.

* * * * *